US005322045A

United States Patent [19]

Hisaki et al.

[11] Patent Number: 5,322,045

[45] Date of Patent: Jun. 21, 1994

[54] MISFIRE-DETECTING SYSTEM FOR INTERNAL COMBUSTION ENGINES

[75] Inventors: Takashi Hisaki; Yuichi Shimasaki; Shigeki Baba; Masaki Kanehiro; Shigeru Maruyama; Takuji Ishioka; Kazuhito Kakimoto; Masataka Chikamatsu; Kenichi Maeda; Shukoh Terata, all of Wako, Japan

[73] Assignee: Honda Giken Kogyo Kabushiki Kaisha, Tokyo, Japan

[21] Appl. No.: 995,470

[22] Filed: Dec. 22, 1992

[30] Foreign Application Priority Data

Dec. 25, 1991 [JP] Japan ..... 3-357066

[51] Int. Cl.[5] ..... F02P 17/00

[52] U.S. Cl. ..... 123/406; 123/479; 324/388; 324/399

[58] Field of Search ..... 123/417, 406, 479, 630; 324/388, 390, 399

[56] References Cited

U.S. PATENT DOCUMENTS

| | | | |
|---|---|---|---|
| 4,928,228 | 5/1990 | Fujimoto et al. | 123/479 |
| 5,215,067 | 6/1993 | Shimasaki et al. | 123/630 |
| 5,237,279 | 8/1993 | Shimasaki et al. | 123/479 |
| 5,241,937 | 9/1993 | Kanehiro et al. | 123/630 |

FOREIGN PATENT DOCUMENTS 4-279768 10/1992 Japan .

*Primary Examiner*—Andrew M. Dolinar
*Attorney, Agent, or Firm*—Nikaido, Marmelstein Murray & Oram

[57] ABSTRACT

A misfire-detecting system for an internal combustion engine detects values of operating parameters of the engine, determines ignition timing of the engine, based upon detected values of operating parameters of the engine to generate an ignition command signal indicative of the determined ignition timing, generates high voltage for causing generation of sparking voltage across a spark plug for discharging the spark plug, according to the ignition command signal, detects a value of the sparking voltage generated across the spark plug when the high voltage is generated, compares the detected value of the sparking voltage with a predetermined reference value, and determines whether or not a misfire has occurred in the engine, based upon results of the comparison. It is determined that the system is abnormal, when it is determined that no misfire has occurred while fuel supply to the engine is being interrupted.

14 Claims, 13 Drawing Sheets 8
12
1ST INPUT CIRCUIT
T2
T3
V
17
A/D CONVERTER
11
CPU
18
2ND INPUT CIRCUIT
9
ENGINE OPERATING PARAMETER SENSORS
16
DRIVING CIRCUIT
A
4
2
1
VB
T1
3
6
10
5a
5
5b A
t0
V
VCOMP
B'
C'

C
B
t0
t2 t3
t5

D'
D
t1 t2
t4
t5
E'
CP
CPREF

E
t0
t1 t2
t4
t6

1
FMIS
0
t0
t6

MISFIRE-DETECTING SYSTEM FOR INTERNAL COMBUSTION ENGINES

BACKGROUND OF THE INVENTION

1. Field of the Invention

This invention relates to a misfire-detecting system for internal combustion engines, and more particularly to a misfire-detecting system of this kind, which is adapted to detect a misfire attributable to the fuel supply system.

2. Prior Art

An internal combustion engine has spark plugs provided for cylinders for igniting a mixture of fuel and air drawn into the respective cylinders. In general, high voltage (sparking voltage) generated by the ignition coil of the engine is sequentially distributed to the spark plugs of the cylinders of the engine via a distributor, to ignite the air-fuel mixture. If normal ignition does not take place at one or more of the spark plugs, i.e. a misfire occurs, it will result in various inconveniences such as degraded driveability and increased fuel consumption. Furthermore, it can also result in so-called afterburning of unburnt fuel gas in the exhaust system of the engine, causing an increase in the temperature of a catalyst of an exhaust gas-purifying device arranged in the exhaust system. Therefore, it is essential to prevent occurrence of a misfire. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called mis-sparking), i.e. normal spark discharge does not take place at the spark plug, due to smoking or wetting of the spark plug with fuel, particularly adhesion of carbon in the fuel to the spark plug, which causes current leakage between the electrodes of the spark plug, or abnormality in the ignition system.

The present assignee has already proposed a misfire-detecting system for detecting misfires attributable to the fuel supply system, which comprises sparking voltage detecting means, and misfire-determining means which determines occurrence of a misfire based on results of comparison between the detected value of the sparking voltage and a predetermined reference value (Japanese Provisional Patent Publication (Kokai) No. 4-279768), and further a misfire-determining system of this kind which comprises sparking voltage-detecting means, and misfire-determining means which determines that a misfire has occurred when a time period (hereinafter referred to as "high voltage time period") over which the detected value of the sparking voltage exceeds a predetermined voltage value or a value proportional to an area (hereinafter referred to as "high voltage area") of a portion of the detected sparking voltage exceeding the predetermined voltage value exceeds a reference value (U.S. Ser. No. 07/846,238 filed Mar. 5, 1992 based on Japanese Patent Application No. 3-67940).

However, according to the above proposed systems, if there exists a portion of the secondary side of the igniting circuit which is low in insulation, the sparking voltage does not rise to a level required for causing dielectric breakdown between the electrodes of the spark plug. As a result, there occurs almost no difference in the sparking voltage, the high voltage time period, or the high voltage area, between when a misfire occurs and when normal firing occurs, which prevents an accurate determination of occurrence of a misfire.

Further, the present assignee has proposed a misfire-detecting system in which a diode is incorporated in the secondary side of the igniting circuit, which serves to prolong the high voltage time period at a misfire to thereby achieve more accurate misfire determination, e.g. by U.S. Ser. No. 07/846,309 filed Mar. 5, 1992. According to this proposed system, however, if the diode is short-circuited, the system can only exhibit the same degree of misfire-detecting accuracy as a system not employing such an diode.

Further, if the spark plug smolders, it is also impossible to achieve an accurate misfire determination based on the high voltage time period, etc.

SUMMARY OF THE INVENTION

It is the object of the invention to provide a misfire-detecting system for an internal combustion engine, which is capable of detecting a fault in the secondary side of an igniting circuit, such as degraded insulation, or malfunctioning of a spark plug, such as smoldering thereof.

To attain the object, the invention provides a misfire-detecting system for an internal combustion engine having at least one cylinder, and a spark plug provided in each of the at least one cylinder, the system including engine operating condition-detecting means for detecting values of operating parameters of the engine, signal-generating means for determining ignition timing of the engine, based upon values of operating parameters of the engine detected by the engine operating condition-detecting means and for generating an ignition command signal indicative of the determined ignition timing, igniting means responsive to the ignition command signal for generating high voltage for causing generation of sparking voltage across the spark plug for discharging the spark plug, voltage value-detecting means for detecting a value of the sparking voltage generated across the spark plug when the high voltage is generated by the igniting means, comparing means for comparing the detected value of the sparking voltage with a predetermined reference value, and misfire-determining means for determining whether or not a misfire has occurred in the engine, based upon results of the comparison by the comparing means.

The misfire-detecting system according to the invention is characterized by comprising abnormality-determining means for determining that the system is abnormal, when the misfire-determining means determines that no misfire has occurred while fuel supply to the engine is being interrupted.

Specifically, the misfire-determining means determines that a misfire has occurred when a degree to which the detected value of the sparking voltage exceeds the predetermined reference value exceeds a predetermined reference value.

More specifically, the degree to which the detected value of the sparking voltage exceeds the predetermined reference value is a time period over which the detected value of the sparking voltage exceeds the first-mentioned predetermined reference value.

Preferably, the second-mentioned predetermined reference value is changed when the fuel supply to the engine is interrupted.

More preferably, the second-mentioned predetermined reference value is changed to a smaller value when the fuel supply to the engine is interrupted.

Alternatively, the degree to which the detected value of the sparking voltage exceeds the predetermined reference value is an amount by which the detected value of the sparking voltage exceeds the first-mentioned predetermined reference value.

Preferably, determination of abnormality of the engine is inhibited for a predetermined time period after the interruption of fuel supply is started, irrespective of whether the misfire-determining means determines that a misfire has occurred.

More preferably, the at least one cylinder comprises a plurality of cylinders, and the abnormality determining means comprises first determining means for determining whether or not the system is abnormal, by monitoring all of the cylinders as a whole, and second determining means for determining whether or not the system is abnormal, by monitoring the cylinders individually.

The above and other objects, features, and advantages of the invention will become more apparent from the ensuing detailed description taken in conjunction with the accompanying drawings.

Figure 5:
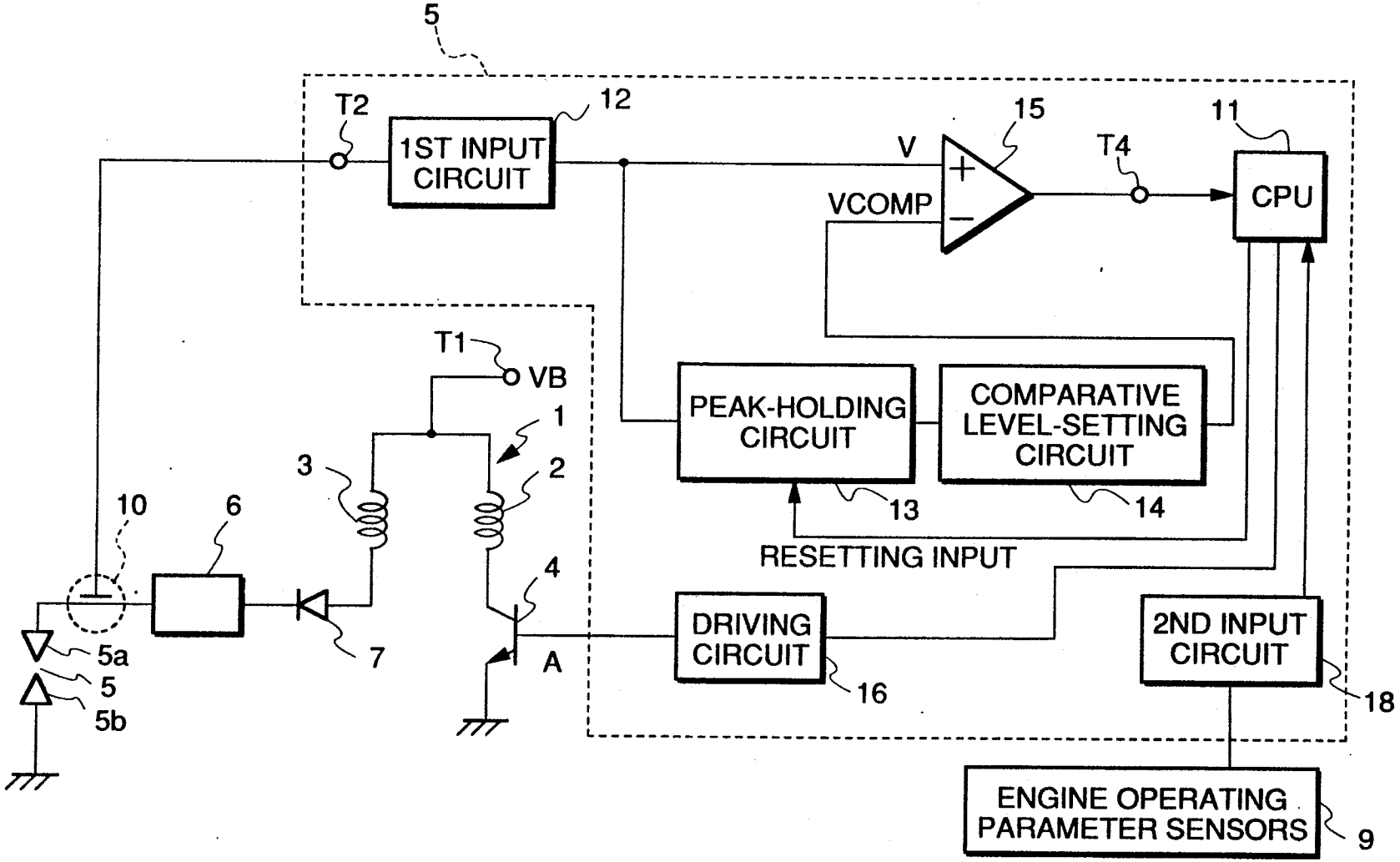
FIG. 5 is a schematic circuit diagram showing the circuit arrangement of a second embodiment of the invention.

FIG. *7a* to FIG. *7e* form together a timing chart which is useful in explaining the operation of the circuit of FIG. 5 in which:

FIG. *7a* shows an ignition command signal A;

FIG. *7b* shows sparking voltage and a comparative voltage level VCOMP;

FIG. *7c* shows an output from a comparator;

FIG. *7d* shows a count value CP of a counter; and

Figure 8:
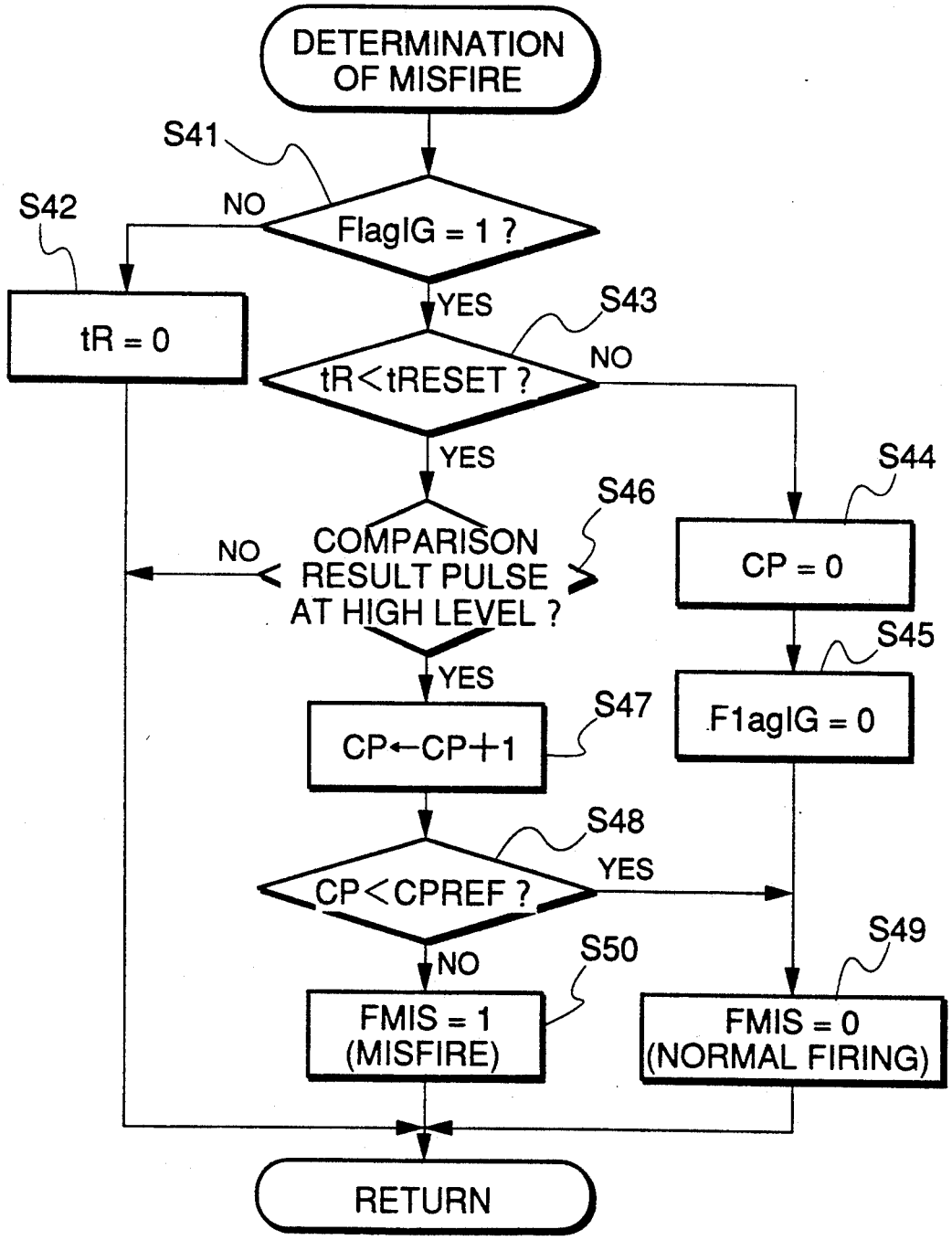
Figure 9:
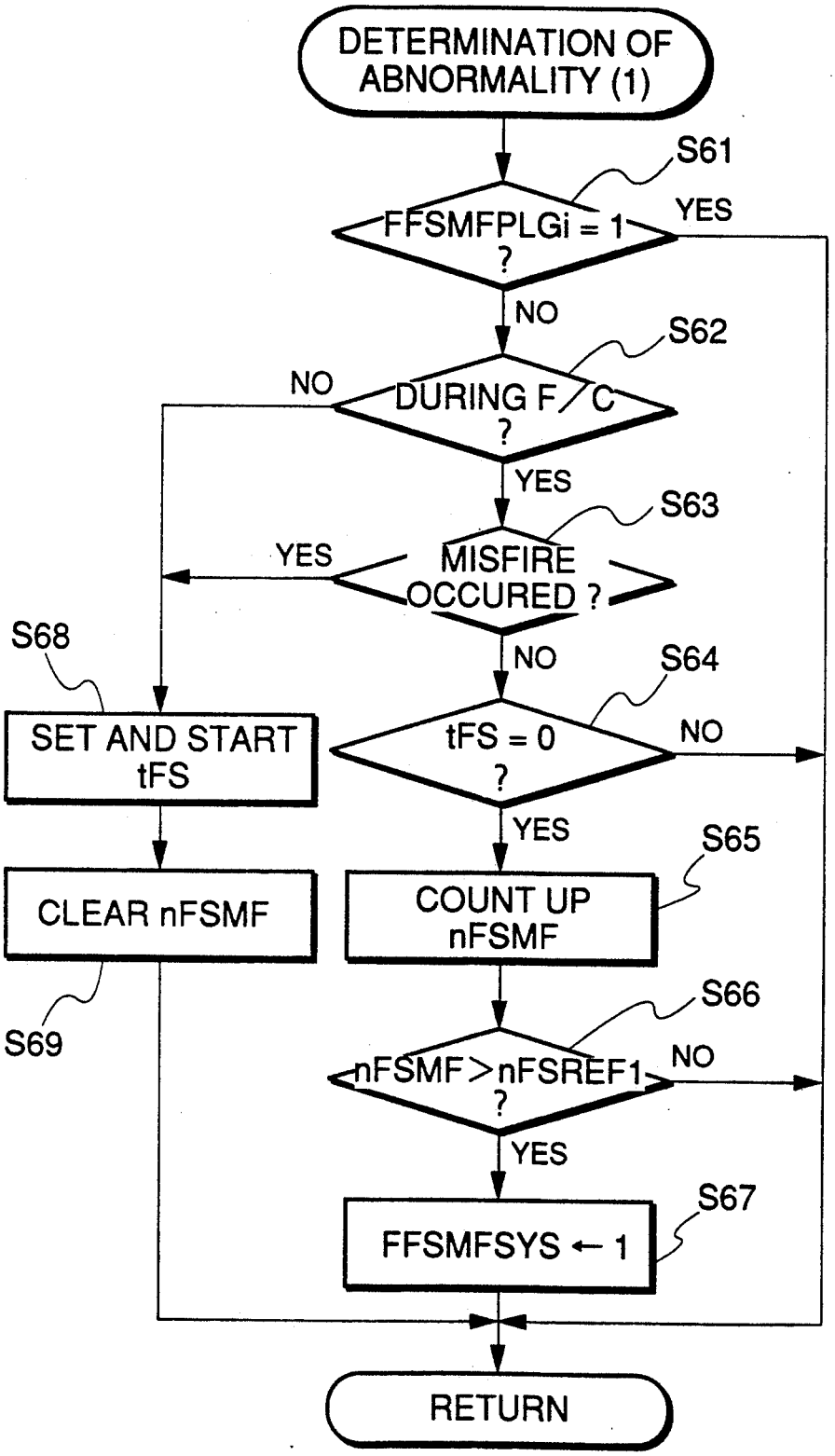
Figure 10:
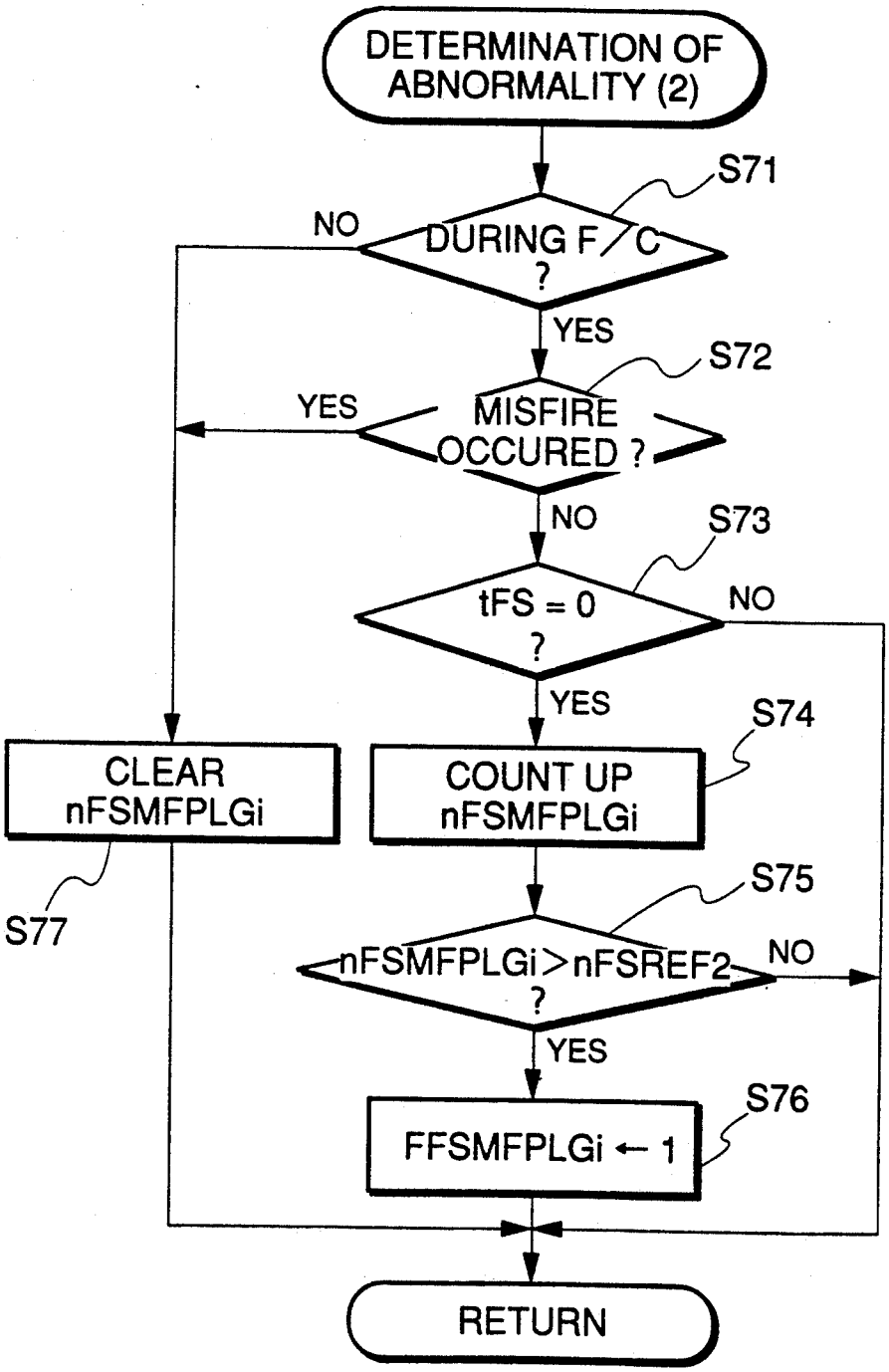
Figure 11:
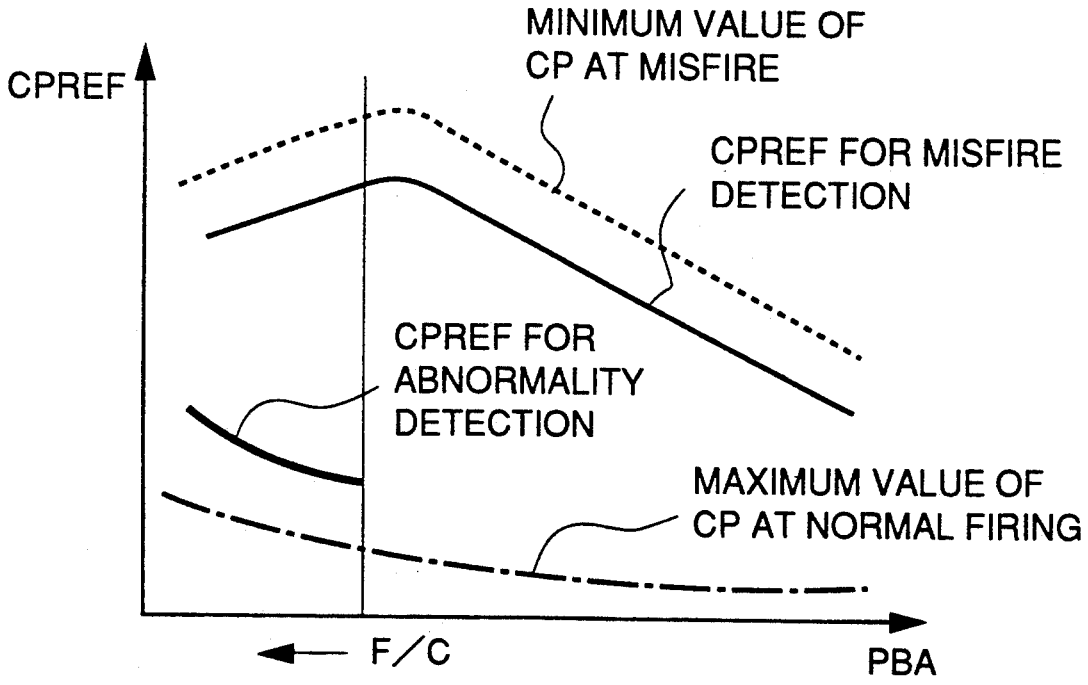
Figure 12:
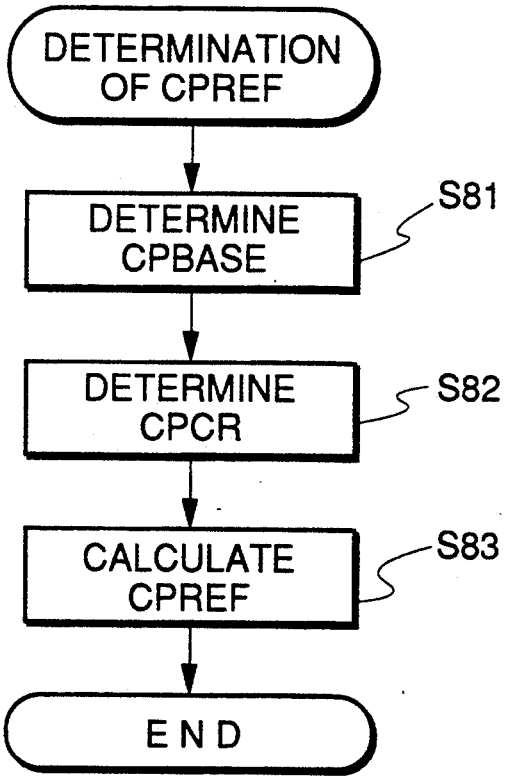
Figure 13:
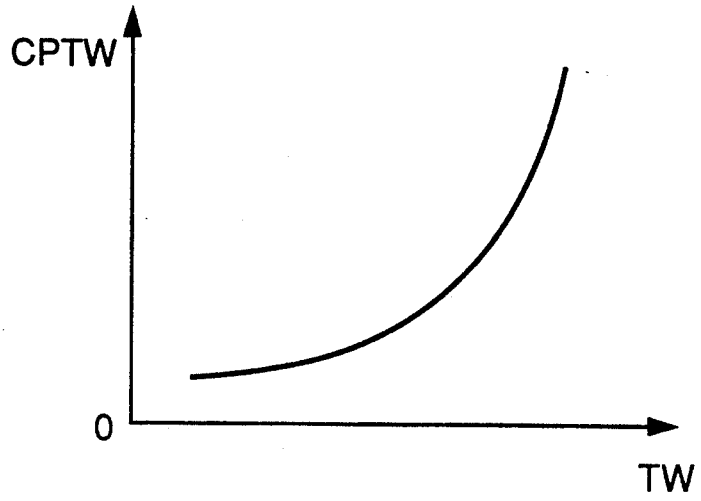
Figure 14:
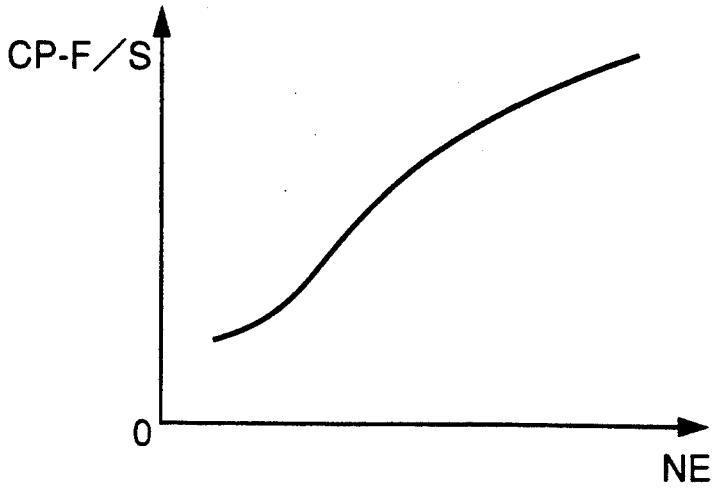

FIG. *7e* shows a misfire detection flag FMIS;

FIG. 8 is a flowchart showing a program for determination of occurrence of a misfire, executed by the first and second embodiments;

FIG. 9 is a flowchart showing a first program for determining whether or not the misfire detecting system is abnormal;

FIG. 10 is a flowchart showing a second program for determining whether or not the misfire detecting system is abnormal;

FIG. 11 is a diagram showing the relationship between a value of a reference value CPREF for use in ordinary misfire determination and a value of the reference value CPREF for use in abnormality determination;

FIG. 12 is a flowchart showing a subroutine for determining the reference value CPREF;

FIG. 13 shows a CPTW map for determining an engine coolant temperature-dependent correction variable CPTW; and FIG. 14 shows a CP-F/S map for determining a subtracting value CP-F/S to be applied when fuel cut is executed.

DETAILED DESCRIPTION

The invention will now be described in detail with reference to the drawings showing embodiments thereof.

Figure 1:
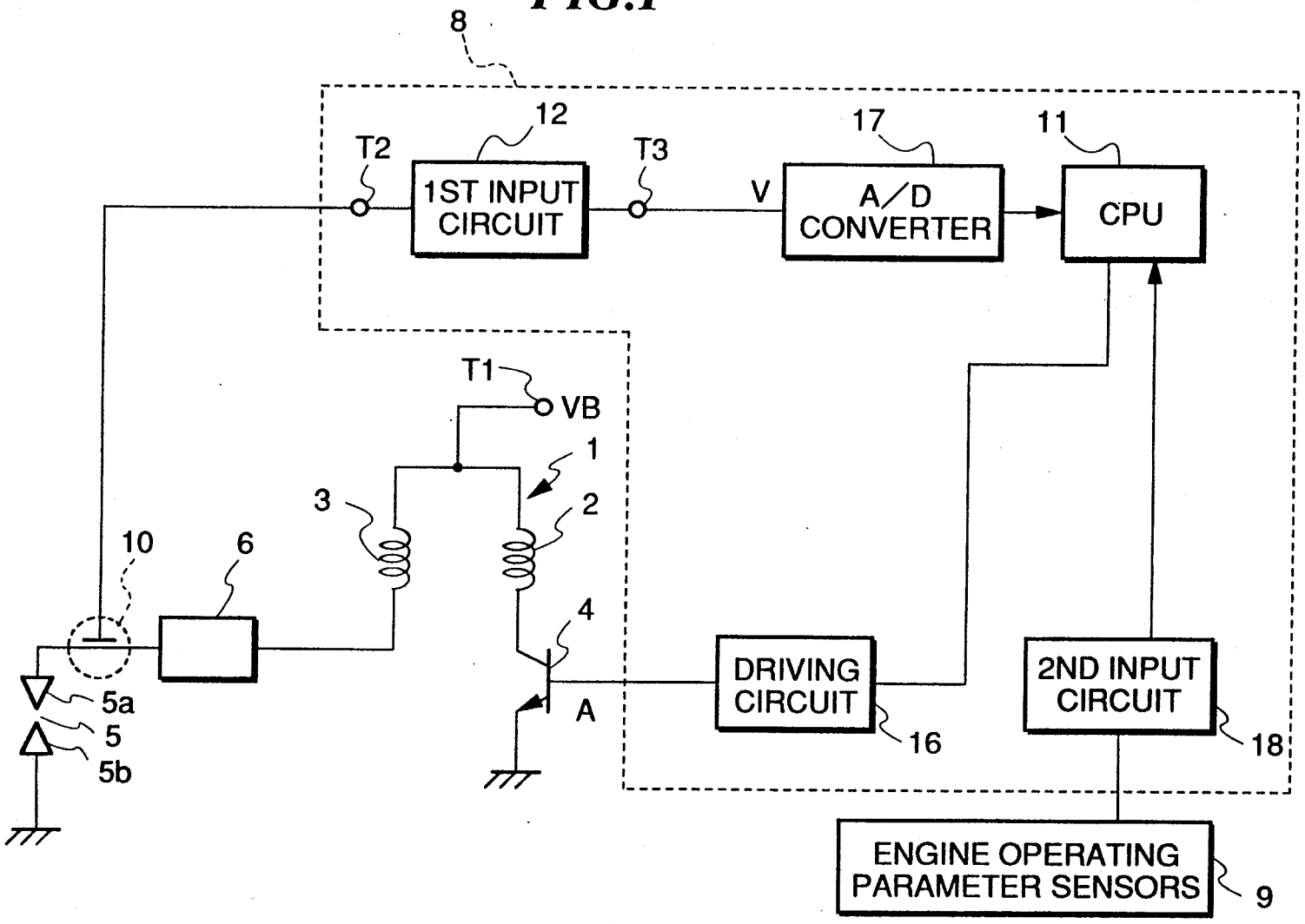
FIG. 1 is a schematic circuit diagram showing the circuit arrangement of the misfiring-detecting system according to a first embodiment of the invention.

Referring first to FIG. 1, there is shown the circuit arrangement of a misfire-detecting system according to a first embodiment of the invention. A feeding terminal T1, which is supplied with supply voltage VB, is connected to an ignition coil 1 comprised of a primary coil 2 and a secondary coil 3. The primary and secondary coils 2, 3 are connected with each other at ends thereof. The other end of the primary coil 2 is connected to a collector of a transistor 4. The transistor 4 has its base connected via a driving circuit 16 to a central processing unit (hereinafter referred to as "the CPU") 11 and its emitter grounded. The base of the transistor 4 is supplied with an ignition command signal A from the CPU 11. The other end of the secondary coil 3 is connected via a distributor 6 to a center electrode 5*a* of a spark plug 5. The spark plug 5 has its grounding electrode grounded.

Provided at an intermediate portion of a connection line connecting between the distributor 6 and the spark plug 5 is a sparking voltage sensor 10 which is electrostatically coupled to the connection line to form a capacitor having a capacitance of several pF's together with the connection line. The sparking voltage sensor 10 is connected via a first input circuit 12 to an A/D converter 17 the output of which is connected to the CPU 11. The output voltage (sparking voltage) V from the sensor 10 is supplied to the first input circuit 12, converted to a digital value by the A/D converter 17 and then supplied to the CPU 11.

Connected via a second input circuit 18 to the CPU 11 are various engine operating parameter sensors 9 for detecting respective operating parameters of the engine, including the engine rotational speed NE, load on the engine such as the intake pipe absolute pressure PBA, the engine coolant temperature TW, and the engine lubricant oil temperature, for supplying the CPU 11 with the detected operating parameter values. Further connected to the CPU 11 via the driving circuit 16 is the base of the transistor 4 to supply the ignition command signal A thereto.

Figure 2:
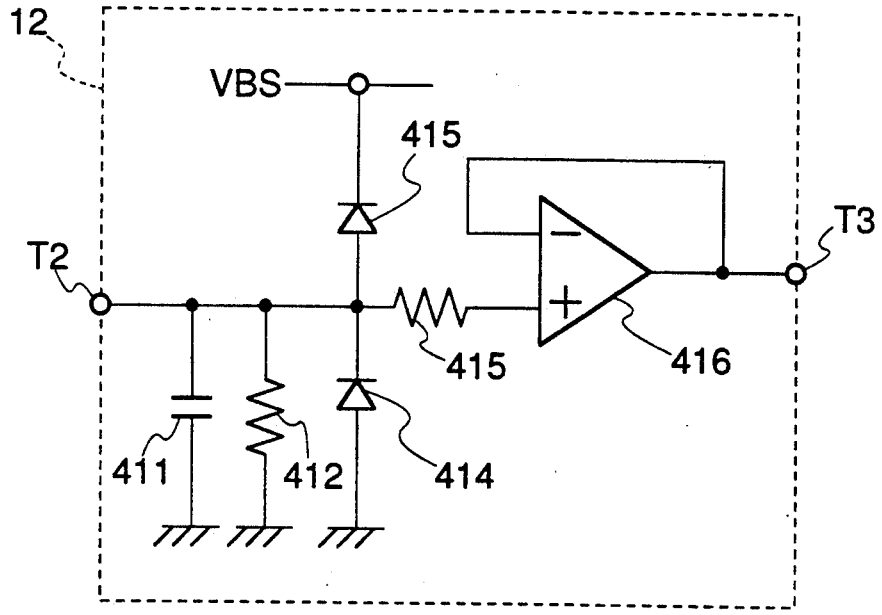
FIG. 2 is a circuit diagram showing details of an input circuit appearing in FIG. 1.

FIG. 2 shows details of the first input circuit 12. In the figure, an input terminal T2 is connected to a non-inverting input terminal of an operational amplifier 416 via a resistance 415. The input terminal T2 is also grounded via a circuit formed of a capacitor 411, a resistance 412, and a diode 414, which are connected in parallel, and connected to a supply voltage-feeding line VBS via a diode 413.

The capacitor 411 has a capacitance of $10^4$pF, for example, and serves to divide voltage detected by the sparking voltage sensor 17 into one over several thousands. The resistance 412 has a value of 500 KΩ, for example. The diodes 413 and 414 act to control the input voltage to the operational amplifier 416 to a range of 0 to VBS. An inverting input terminal of the operational amplifier 416 is connected to the output of the same so that the operational amplifier 416 operates as a buffer amplifier (impedance converter). The output from the operational amplifier 416 is supplied to the A/D converter 45 as the sparking voltage V.

Figure 3:
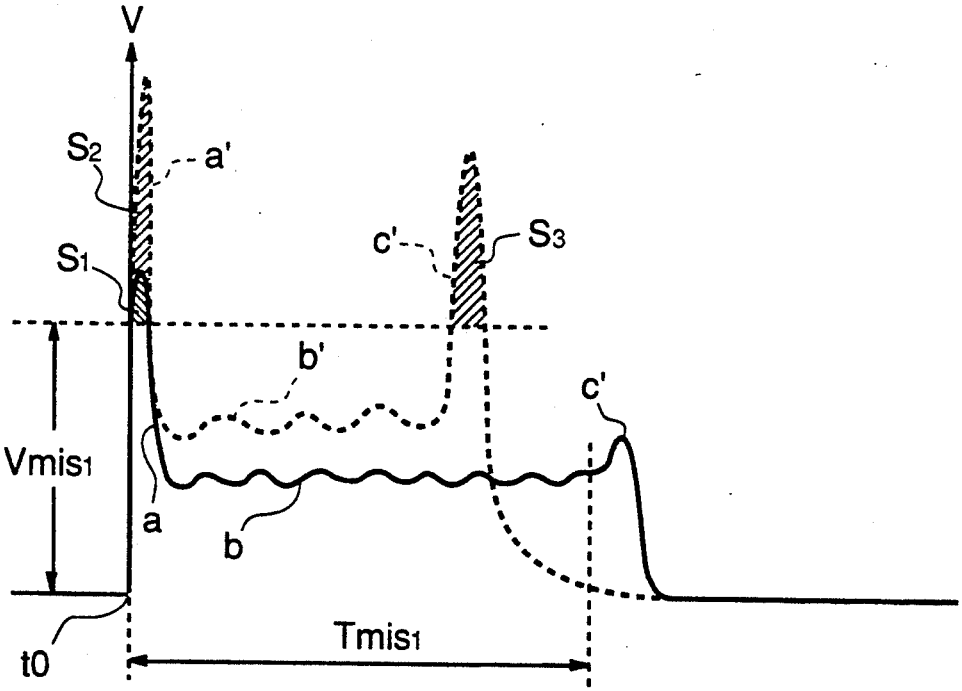
FIG. 3 is a timing chart showing changes in the sparking voltage occurring at normal firing and those occurring at a misfire.

FIG. 3 is a timing chart showing changes in the sparking voltage (primary voltage) with the lapse of time upon generation of the ignition command signal, wherein the solid line depicts changes in the sparking voltage, which occur when the air-fuel mixture is normally fired, and the broken line changes in the sparking voltage, which occur when a misfire occurs, which is attributable to the fuel supply system (hereinafter referred to as "the FI misfire").

First, a sparking voltage characteristic obtainable in the case of normal firing will be explained, which is indicated by the solid line. Immediately after a time point t0 the ignition command signal A is generated, sparking voltage V rises to such a level as to cause dielectric breakdown of the mixture between the electrodes of the spark plug, i.e. across the discharging gap of the spark plug (curve a). For example, as shown in FIG. 3, when the sparking voltage V has exceeded a reference voltage value Vmis1 for determination of an FI misfire, i.e. when V>Vmis1, dielectric breakdown of the mixture occurs, and then the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow (curve b). The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge occurs. In this capacitive discharge state, the voltage between the spark plug electrodes again rises, i.e. in the direction of causing dielectric breakdown of the mixture. However, since the ignition coil 1 then has a small amount of residual energy, the amount of rise of the voltage is small (curve c). This is because the electrical resistance of the discharging gap is low due to ionizing of the mixture during firing.

Next, reference is made to a sparking voltage characteristic indicated by the broken line, which is obtained when a FI misfire occurs, i.e. no firing occurs, which is caused by the supply of a lean mixture to the engine or cutting-off of the fuel supply to the engine due to failure of the fuel supply system, etc. Immediately after the time point t0 of generation of the ignition command signal A, the sparking voltage rises above a level causing dielectric breakdown of the mixture. In this case, the ratio of air in the mixture is greater than when the mixture has an air-fuel ratio close to a stoichiometric ratio, and accordingly the dielectric strength of the mixture is high. Besides, since the mixture is not fired, it is not ionized so that the electrical resistance of the discharging gap of the plug is high. Consequently, the dielectric breakdown voltage becomes higher than that obtained in the case of normal firing of the mixture (curve a'), as shown in FIG. 3.

Thereafter, the discharge state shifts to an inductive discharge state, as in the case of normal firing (curve b'). Also, the electrical resistance of the discharging gap of the plug at the discharge of the ignition coil is greater in the case of supply of a lean mixture, etc. than that in the case of normal firing so that the inductive discharge voltage rises to a higher level than at normal firing, resulting in an earlier shifting from the inductive discharge state to a capacitive discharge state (late-stage capacitive discharge). The capacitive discharge voltage upon the transition from the inductive discharge state to the capacitive discharge state is by far higher than that at normal firing (curve c'), because the voltage of dielectric breakdown of the mixture is higher than that at normal firing, and also because the ignition coil still has a considerable amount of residual energy due to the earlier termination of the inductive discharge (i.e. the discharge duration is shorter). Therefore, immediately after this late-stage capacitive discharge, the sparking voltage sharply drops to approx. zero volts, because the residual energy of the ignition coil sharply decreases.

Figure 4:
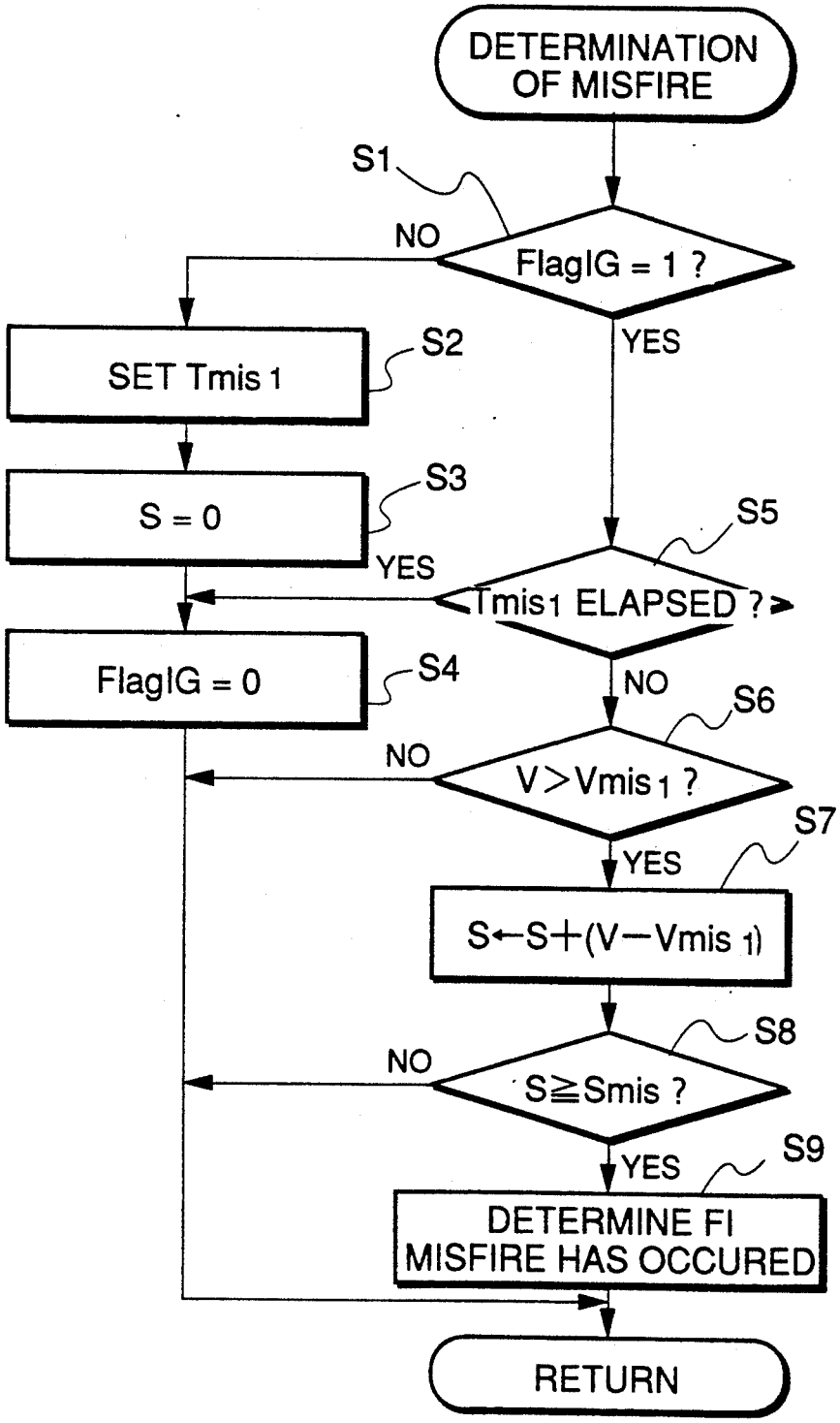
FIG. 4 is a flowchart showing a program for determination of occurrence of a misfire, executed by the misfire-detecting system according to the first embodiment.

FIG. 4 shows a program for determining occurrence of a misfire (misfire determination), which is executed by the CPU 11 at predetermined fixed intervals.

First, at a step S1, it is determined at a step S1 whether or not a flag IG, which is indicative of whether or not the ignition command signal A has been generated, has been set to a value of 1. The flag IG indicates, when set to 1, that the signal A has been generated. The flag IG is thus set to 1 upon generation of the signal A, and then reset to 0 upon the lapse of a predetermined time period. When the ignition command signal A has not been generated, the answer to the question of the step S1 is negative (NO), and then the program proceeds to steps S2, S3 and S4, successively, where a timer, which measures time elapsed after generation of the ignition command signal A, is set to a predetermined time period Tmis1, and started, a value proportional to an area S, hereinafter referred to, is initialized to zero and stored in the memory means 5*c*, and the flag IG is set to 0, followed by terminating the program. The value proportional to the area S will be simply referred to as "the value of the area S" hereinafter. The flag IG is set to 1 upon generation of the signal A, by a routine other than the FIG. 5 routine, e.g. an ignition timing-calculating routine.

The predetermined time period Tmis1 is set at a time period slightly longer than a time period from the time of generation of the ignition command signal A to the time of generation of the late-stage capacitive discharge, assumed when a normal firing occurs. The time period Tmis1, as well as predetermined values Vmis1 and Smis, hereinafter referred to, are each read from a map or a table in accordance with operating conditions of the engine 1.

When the ignition command signal A has been generated and hence the flag IG has been set to 1, the program proceeds from the step S1 to a step S5 to determine whether or not the predetermined time period Tmis1, counted by the timer has elapsed (see FIG. 3). Immediately after generation of the ignition command signal A, the predetermined time period Tmis1 has not yet elapsed, so that the program proceeds to a step S6 to determine whether or not the sparking voltage V has exceeded the reference voltage value Vmis1 (see FIG. 3). The reference voltage value Vmis1 is set to a value which the sparking voltage V necessarily exceeds during the early-stage capacitive discharge in the case of normal firing. If $V \leqq Vmis1$, the program is immediately terminated. If $V > Vmis1$, an area is calculated at a step S7, which is defined by the line indicative of the reference voltage value Vmis1 and a portion of the curve indicative of the sparking voltage which is higher than the value Vmis1. The value of this area is added to the value of the area S stored in the memory means 5c to obtain a new value of the area S. Then, it is determined at a step 8 whether or not the new value of the area S exceeds a predetermined value Smis. If the former exceeds the latter, it is determined at a step S9 that an FI misfire has occurred, whereas if the former does not exceed the latter, the program is terminated, determining that no FI misfire has occurred. The above procedure is repeatedly carried out until the predetermined time period Tmis1, counted by the timer, elapses (step S5). The predetermined value Smis is set to a value which is smaller than a value of the area S which can be obtained by addition when an FI misfire occurs.

Values of the area S are exemplified in FIG. 3. In the figure, an area S1 hatched by lines falling rightward shows a value of the area S in the case of a normal firing, while the sum of areas S2 and S3 shows a value of the area S in the case of an FI misfire. The value of the area S in the case of an FI misfire is much larger than that of the area S in the case of a normal firing, so that the former exceeds the predetermined value Smis without fail.

In addition, in FIG. 3, the values of areas S1 and S2 are calculated during the early-stage capacitive discharge, and the area S3 is calculated during the late-stage capacitive discharge. In the program of FIG. 4, the area S means the area S1 alone or the sum of the areas S2 and S3.

FIG. 5 shows the circuit arrangement of a misfire-detecting system according to a second embodiment of the invention. In the figure, elements and parts corresponding to those of the first embodiment shown in FIG. 2 are designated by identical reference numerals. The first input circuit 12 is connected to a peak-holding circuit 13 and a non-inverting input terminal of a comparator 15. The output of the peak-holding circuit 13 is connected via a comparative level-setting circuit 14 to an inverting input terminal of the comparator 15. A resetting input terminal of the peak-holding circuit 13 is connected to the CPU 11 to be supplied with a resetting signal therefrom at an appropriate time for resetting a peak value of the sparking voltage held by the peak-holding circuit 13. An output from the comparator 15 is supplied to the CPU 11. Further, a diode 7 is connected between the secondary coil 3 of the ignition coil and the distributor 6. Except for those described above, the circuit arrangement of FIG. 5 is identical with that of the first embodiment shown in FIG. 1.

Figure 6:
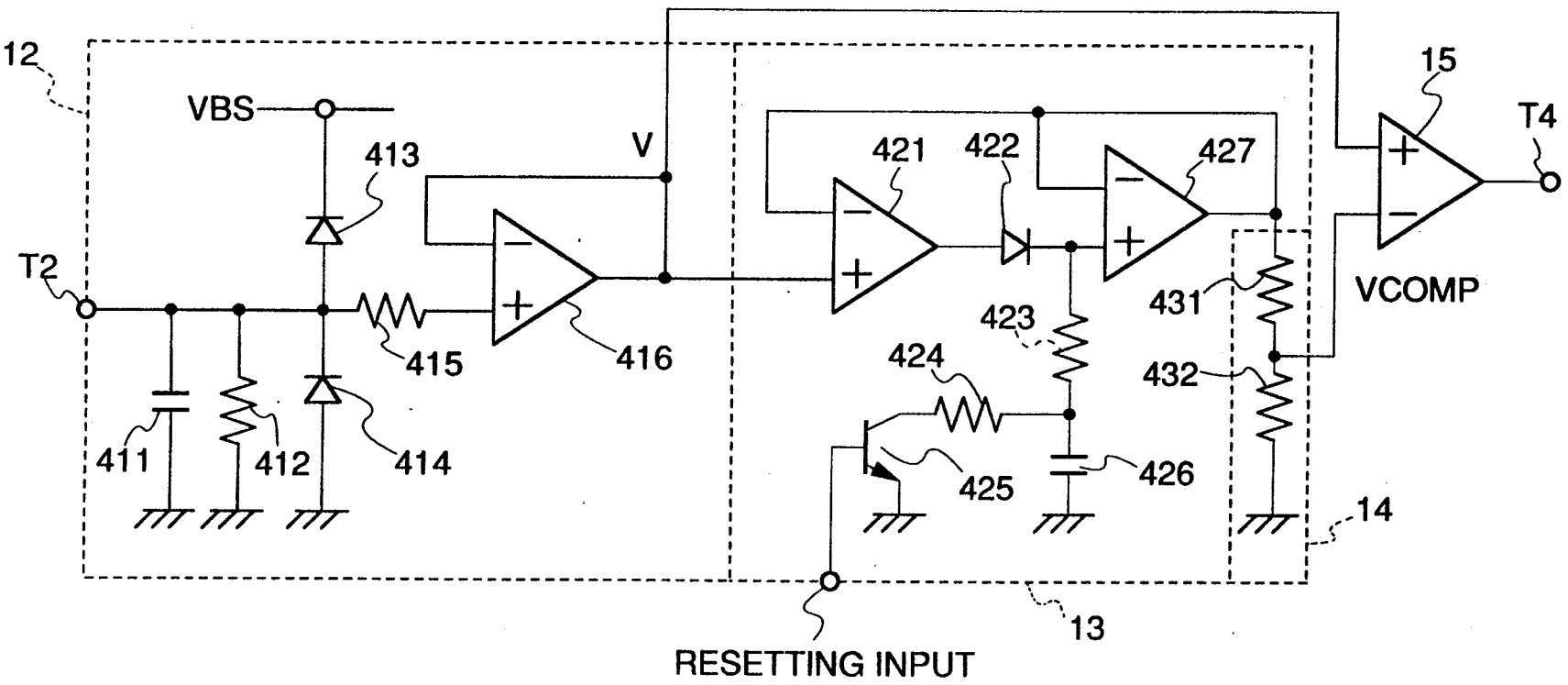
FIG. 6 is a circuit diagram showing details of an input circuit, a peak-holding circuit, and a comparative level-setting circuit appearing in FIG. 5.

FIG. 6 shows details of the first input circuit 12, the peak-holding circuit 13 and the comparative level-setting circuit 14. The first input circuit 12 is identical with that shown in FIG. 2.

In FIG. 6, the output of the amplifier 416 is connected to the non-inverting input terminal of the comparator 15 as well as an inverting input terminal of an operational amplifier 421. The output of the operational amplifier 421 is connected to a non-inverting input terminal of an operational amplifier 427 via a diode 422, with inverting input terminals of the amplifiers 421, 427 both connected to the output of the amplifier 427. Therefore, these operational amplifiers form a buffer amplifier.

The non-inverting input terminal of the operational amplifier 427 is grounded via a resistance 423 and a capacitor 426, the junction therebetween being connected to a collector of a transistor 425 via a resistance 424. The transistor 425 has its emitter grounded and its base supplied with a resetting signal from the CPU 5b. The resetting signal goes high when resetting is to be made.

The output of the operational amplifier 427 is grounded via resistances 431 and 432 forming the comparative level-setting circuit 14, the junction between the resistances 431, 432 being connected to the inverting input terminal of the comparator 15.

The circuit of FIG. 6 operates as follows: A peak value of the detected sparking voltage V (output from the operational amplifier 416) is held by the peak-holding circuit 13, the held peak value is multiplied by a predetermined value smaller than 1 by the comparative level-setting circuit 14, and the resulting product is applied to the comparator 15 as the comparative level VCOMP. Thus, a pulse signal indicative of the comparison result, which goes high when $V > VCOMP$ stands, is output from the comparator 15 through a terminal T4.

The operation of the misfire-detecting system constructed as above according to this embodiment will now be explained with reference to a timing chart of FIG. *7a* to FIG. *7e*. In FIG. *7b* to FIG. *7e*, the solid lines show operation at normal firing, while the broken lines show operation at FI misfire.

FIG. *7a* shows the ignition command signal A, and FIG. *7b* show changes in the detected sparking voltage V (B, B') and the comparative level (C, C') with the lapse of time. The curve B at normal firing changes in a similar manner to the curve at normal firing in FIG. 3, referred to hereinbefore. The curve B' at an FI misfire shows a different characteristic from that in FIG. 3 after the capacitive discharge voltage shows a peak immediately before the termination of the discharge. This is because the diode 7 is provided between the secondary coil 3 and the distributor 6, as shown in FIG. 5. This will be explained in detail below.

Electric energy generated by the ignition coil 1 is supplied to the spark plug 5 via the diode 7 and the distributor 6 to be discharged between the electrodes of the spark plug 5. Residual charge left after the discharge is stored in the floating capacitance between the diode 7 and the spark plug 5. At normal firing, the stored charge is neutralized by ions present in the vicinity of the electrodes of the spark plug 5, so that the sparking voltage V promptly declines after the termination of the capacitive discharge as if the diode 7 were not provided (B in FIG. *7b*)

On the other hand, when a misfire occurs, almost no ion is present in the vicinity of the electrodes of the spark plug 5 so that the charge stored between the diode 7 and the spark plug 5 is not neutralized, nor is it allowed to flow backward to the ignition coil 1 due to the presence of the diode 7. Therefore, the charge is held as it is without being discharged through the electrodes of the spark plug 5. Then, when the pressure within the engine cylinder lowers so that the voltage between the electrodes of the spark plug 5 required for discharge to occur becomes equal to the voltage applied by the charge, there occurs a discharge between the electrodes (time point t5 in FIG. *7b*). Thus, by virtue of the action of the diode 7, even after the termination of the capacitive discharge, the sparking voltage V is maintained in a high voltage state over a longer time period than at normal firing.

Figures 7A, 7B, 7C, 7D, 7E:
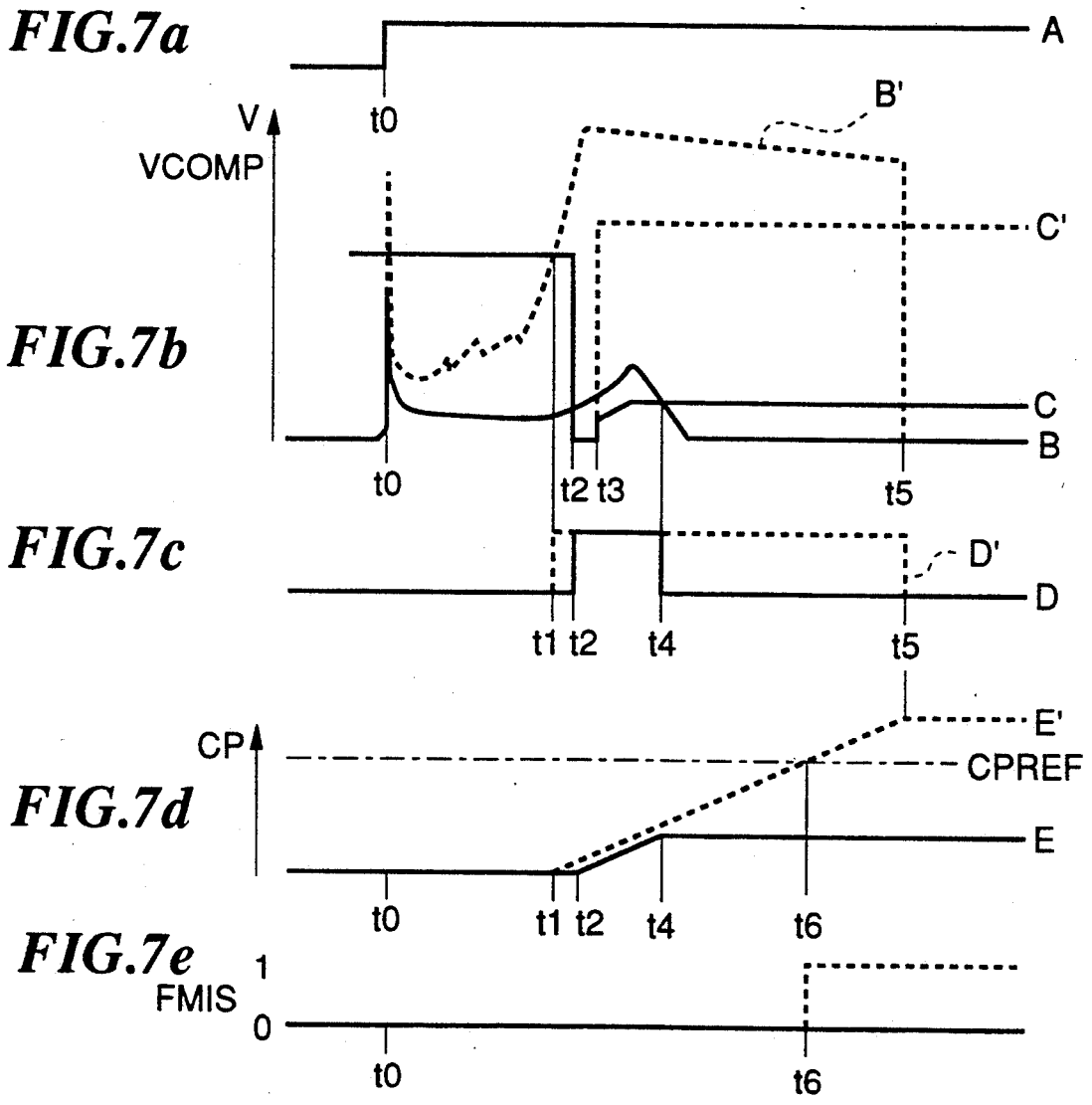

The curves C, C' in FIG. 7*b* show changes in the comparative level VCOMP with the lapse of time, obtained from the held peak value of the sparking voltage V. The peak-holding circuit 13 is reset during time points t2 and t3. Therefore, the curves before the time point t2 show the comparative level VCOMP obtained from the last cylinder which was subjected to ignition. FIG. 7*c* shows outputs from the comparator 15. As is clear from FIG. 7*b* and FIG. 7*c*, at normal firing, V>VCOMP holds between time points t2 and t4, whereas at a misfire, V>VCOMP holds between time points t1 and t5, and during each of the durations, the output from the comparator 15 has a high level.

Therefore, it is possible to determine occurrence of a misfire by measuring the pulse duration of the pulse signal indicative of the comparison result outputted from the comparator 15, and comparing the pulse duration with a reference value.

FIG. 8 shows a program for determining occurrence of a misfire based on the comparison result pulse, which is executed by the CPU 11 at predetermined fixed intervals, or alternatively whenever ignition is effected.

First, at a step S41, it is determined whether or not the flag IG is equal to 1. If the answer to this question is negative (NO), i.e. if the flag IG is equal to 0 a measured time value tR of a resetting timer is set to 0 at a step S42, followed by terminating the program. If the answer to the question of the step S41 is affirmative (YES), i.e. if the flag IG is equal to 1, it is determined at a step S43 whether or not the value tR of the resetting timer is smaller than a predetermined value tRESET. Immediately after the flag IG has been changed from 0 to 1, the answer to this question is affirmative (YES), and then at a step S46, it is determined whether or not the comparison result pulse from the comparator 15 assumes a high level. If the answer to this question is affirmative (YES), a count value CP of a counter is increased by an increment of 1 at a step S47, and then it is determined at a step S48 whether or not the resulting count value CP is smaller than a predetermined value CPREF.

If the answer to the question of the step S48 is affirmative (YES), i.e. if CP<CPREF, it is determined that a normal firing has occurred, and a flag FMIS is set to 0 at a step S49, whereas if the answer is negative (NO), i.e. if CP≧CPREF, it is determined that an FI misfire has occurred, and the flag FMIS is set to 1 at a step S50, followed by terminating the program.

If the answer to the question of the step S43 becomes negative (NO), i.e. tR>tRESET, the count value CP and the flag IG are both reset to 0 at respective steps S44 and S45, followed by the program proceeding to the step S49.

According to the FIG. 8 program described above, as shown in FIG. 7*d* and FIG. 7*e*, the count value CP does not exceed the reference value CPREF at a normal firing, whereas the former exceeds the latter at a misfire, e.g. at the time point t6 in the illustrated example, whereupon a misfire is determined to have occurred, and then the flag FMIS is changed from 0 to 1.

FIG. 9 shows a first program carried out by the misfire-detecting systems of the first and second embodiments described above for determining whether or not the misfire-detecting system is abnormal, which is executed in synchronism with generation of each TDC signal pulse.

At a step S61, it is determined whether or not an individual cylinder abnormality detection flag FFSMFPLGi is equal to 1, which flag is set to 1 when abnormality is detected with respect to each cylinder by a second program for determining abnormality, shown in FIG. 10. The flag FFSMFPLGi is provided for each of the engine cylinders. The letter "i" designates the number of the cylinder subjected to abnormality determination, and, e.g. in a four-cylinder engine, i=1 to 4. If the answer to the question of the step S61 is affirmative (YES), i.e. if at least one of FFSMFPLGi (i=1 to 4) is equal to 1, the program is immediately terminated.

If the answer to the question of the step S61 is negative (NO), it is determined at a step S62 whether or not interruption of supply of fuel to the engine (hereinafter referred to as "fuel cut") is being carried out. If the answer to this question is affirmative (YES), it is determined at a step S63 whether or not a misfire is determined to have occurred in a cylinder as to which the misfire determination has been completed, i.e., a misfire is determined to have occurred in the cylinder by the program shown in FIG. 4 or FIG. 8, immediately before execution of the present program.

If the answer to the question of the step S62 is negative (NO), i.e. if fuel cut is not being carried out, it is impossible to carry out the abnormality determination, so that a timer tFS is set to a predetermined value (e.g. 0.1 seconds) and started at a step S69, followed by terminating the program. If both the answers to the questions of the steps S62 and S63 are affirmative (YES), i.e. if it is determined that a misfire has occurred while fuel cut is being effected, it is determined that the system is normal, followed by the program proceeding to the step S68.

If the answer to the question of the step S63 is negative (NO), i.e. it is not determined that a misfire has occurred even while fuel cut is being effected, it is determined at a step S64 whether or not the count value of the timer tFS is equal to 0. If the answer to this question is negative (NO), i.e. if tFS>0, which means that the predetermined time period has not elapsed after the start of fuel cut, the program is terminated, whereas if the answer is negative (NO), i.e., if tFS=0, a count value of a counter nFSMF is increased by an increment of 1 at a step S65. At the following step S66, it is determined whether or not the count value of the counter nFSMF is larger than a first predetermined reference nFSREF1 (e.g. 10). If the answer to this question is negative (NO), i.e. if nFSMF≦nFSREF1, the program is terminated.

If the answer to the question of the step S66 is affirmative (YES), i.e. if nFSMF>nFSREF1, it is determined that the misfire-detecting system is abnormal, and a system abnormality detection flag FFSMFSYS is set to a value of 1 at a step S67, followed by terminating the program.

According to the program described above, if no misfire has been continuously detected over a time period during which have been generated TDC signal pulses of the number corresponding to the first predetermined count value nFSREF1, in spite of execution of fuel cut, it is determined that the misfire-detecting system is abnormal. This makes it possible to detect deterioration in the insulation of a portion extending from the secondary coil 3 to the distributor 6 (common to all the cylinders) and a short-circuit in the diode 7 appearing in FIG. 5.

Further, the abnormality determination is inhibited before the predetermined time period elapses after the start of fuel cut (which is determined at the step S64) for the purpose of eliminating the influence of residual fuel remaining in the intake system and the cylinders immediately after the start of fuel cut.

FIG. 10 shows a second program for determining whether the misfire-detecting system is abnormal, which is also executed in synchronism with generation of each TDC signal pulse.

In the figure, steps S71 to S73 are identical with the steps S62 to S64 in FIG. 9.

If the answer to the question of the step S71 is negative (NO) or if the answer to the question of the step S72 is affirmative (YES), a count value of a counter nFSMFPLGi is set to 0 at a step S77, followed by terminating the program. Here, the letter "i" of nFSMFPLGi designates the number of the cylinder subjected to abnormality determination, and the counters nFSMFPLGi are operated for the respective cylinders, similarly to the individual cylinder abnormality detection flags FFSMFPLGi. More specifically, the counter which is reset at the step S77 corresponds to a cylinder as to which the misfire determination has been completed immediately before execution of the present program (hereafter referred to as "the monitored cylinder").

If the answer to the question of the step S73 is affirmative (YES), i.e. if the predetermined time period has not elapsed after the start of fuel cut, the count value of the counter nFSMFPLGi corresponding to the monitored cylinder is increased by an increment of 1 at a step S74. When the resulting count value exceeds a second predetermined reference value nFSREF2 (e.g. 5) (the answer to the question of the step S75 is affirmative (YES)), the individual cylinder abnormality detection flag FFSMFPLGi of the monitored cylinder is set to 1 at a step S76.

According to the present program, if no misfire has been continuously detected in a particular cylinder over a time period corresponding to the number (nSFSREF2) of misfire determinations effected for the cylinder (in other words, no misfire has been continuously detected over a time period corresponding to a number (nFSREMF2×4) of TDC signal pulses (in the case of a four-cylinder type engine), in spite of execution of fuel cut, it is determined that the misfire-detecting system is abnormal. This enables to detect deterioration in the insulation of separate portions of the system extending from the distributor 6 to the spark plugs 5 and smoldering of a spark plug 5, cylinder by cylinder.

As described heretofore, according to the FIG. 9 and FIG. 10 programs, abnormality of the misfire-detecting system can be detected at an early time, while discriminating the type of abnormality between one occurring in a portion common to all the cylinders and one occurring in a portion corresponding to a particular cylinder.

Next, a third embodiment of the invention will be described with reference to FIG. 11 to FIG. 14.

This embodiment is distinguished from the second embodiment in that the reference value CPREF to be used at the step S48 in the FIG. 8 program for misfire determination is modified for use in determining abnormality of the misfire-detecting system. More specifically, as shown in FIG. 11, in ordinary misfire determination, the reference value CPREF is set to a value (indicated by the solid line in the figure) which is slightly lower than the minimum value (indicated by the broken line in the figure) of the count value CP to be assumed when a misfire has occurred, to thereby determine whether a misfire has occurred. However, in the event that abnormality of the misfire-detecting system is determined depending on whether it is determined thereby that no misfire has occurred (that is, whether it is determined by the misfire-detecting system that normal firing has occurred) when the fuel supply to the engine is interrupted, as in the present invention, it is preferable to set the reference value CPREF to a value (indicated by the thick solid line in the figure) which is slightly higher than the maximum value (indicated by the one-dot-chain line in the figure) of the count value CP to be assumed when normal firing has occurred, to thereby improve accuracy of abnormality determination.

FIG. 12 shows a subroutine for determining the reference value CPREF according to the present embodiment, which is executed at predetermined proper timing relative to timing of execution of the FIG. 8 program.

First at a step S81, a map value CPBASE of the reference value CPREF is determined by retrieving a CPBASE map, or additionally by interpolation if required, according to detected values of the engine rotational speed NE and the intake pipe absolute pressure PBA. The CPBASE map is set, e.g. such that optimum values of the map value CPBASE are provided correspondingly to predetermined values of the engine rotational speed NE and the intake pipe absolue pressure PBA.

Then, at a step S82, a correction variable CPCR is determined. The correction variable CPCR is the sum of correction variables determined according to respective various parameters of engine operating conditions, such as the engine coolant temperature TW, the intake air temperature TW, the battery voltage VB, etc. For example, an engine coolant temperature-dependent correction variable CPTW is determined by reading from a CPTW map according to a detected value of the engine coolant temperature TW and additionally by interpolation if required. The CPTW map is set, e.g. as shown in FIG. 13, such that optimum values of the correction variable CPTW are provided correspondingly to predetermined values of the engine coolant temperature TW.

Then, the program proceeds to a step S83, where the reference value CPREF is calculated by the use of the following equation:

$$CPREF = CPBASE + CPCR - CP\text{-}F/S,$$

followed by terminating the present subroutine. In the equation, CP-F/S represents a subtracting correction variable which is set to 0 except when fuel cut is being carried out, and assumes a value larger than 0 only when fuel cut is being carried out. The correction variable CP-F/S is determined by reading from a CP-F/S map according to a detected value of an engine operating parameter, such as the engine rotational speed NE or the intake pipe absolute pressure PBA, and additionally by interpolation, if required. The CP-F/S map is set, e.g. as shown in FIG. 14 such that optimum values of the correction variable or subtracting value CP-F/S are provided correspondingly to predetermined values of an engine operating parameter, i.e. the engine rotational speed NE in the case of this figure.

According to the FIG. 12 program, except when fuel cut is being carried out, the reference value CPREF is set to an ordinary value for use in determining occurrence of a misfire, whereas when fuel cut is being carried out, the reference value CPREF is set to a value lower than the ordinary value for misfire determination, which contributes to improving the accuracy of abnormality determination.

In addition, the peak-holding circuit 13 in FIG. 5 may be replaced by an averaging circuit (integrating circuit).

In the second embodiment described above, a value proportional to an area defined by the line indicative of the comparative level VCOMP and a portion of the curve indicative of the detected sparking voltage V which is higher than the comparative level VCOMP (i.e. a value obtained by integrating (V−VCOMP)) may be calculated to detect a misfire in a manner similar to the first embodiment. Further, the first embodiment may be combined with the second embodiment so as to determine occurrence of a misfire only when the results obtained by the two embodiments both indicate occurrence of a misfire.

Further, in determining occurrence of a misfire based on the above-mentioned area-proportional value, it is preferable that a reference value for the misfire determination (Smiss in the first embodiment) should be set in dependence on operating conditions of the engine, similarly to the reference value CPREF.

Moreover, the measurement of the duration of the comparison result pulse in the second embodiment may be carried out only during a preset gating time period (which is set e.g. in the latter half of the discharge period), as disclosed in U.S. Ser. No. 07/846,309 assigned to the present assignee.

What is claimed is:

1. In a misfire-detecting system for an internal combustion engine having at least one cylinder, and a spark plug provided in each of said at least one cylinder, said system including engine operating condition-detecting means for detecting values of operating parameters of said engine, signal-generating means for determining ignition timing of said engine, based upon values of operating parameters of said engine detected by said engine operating condition-detecting means and for generating an ignition command signal indicative of the determined ignition timing, igniting means responsive to said ignition command signal for generating high voltage for causing generation of sparking voltage across said spark plug for discharging said spark plug, voltage value-detecting means for detecting a value of said sparking voltage generated across said spark plug when said high voltage is generated by said igniting means, comparing means for comparing the detected value of said sparking voltage with a predetermined reference value, and misfire-determining means for determining whether or not a misfire has occurred in said engine, based upon results of said comparison by said comparing means;

the improvement comprising abnormality-determining means for determining that said system is abnormal, when said misfire-determining means determines that no misfire has occurred while fuel supply to said engine is being interrupted.

2. A misfire-detecting system according to claim 1, wherein said misfire-determining means determines that a misfire has occurred when a degree to which the detected value of said sparking voltage exceeds said predetermined reference value exceeds a predetermined reference value.

3. A misfire-detecting system according to claim 2, wherein said degree to which the detected value of said sparking voltage exceeds said predetermined reference value is a time period over which the detected value of said sparking voltage exceeds said first-mentioned predetermined reference value.

4. A misfire-detecting system according to claim 2 or 3, wherein said second-mentioned predetermined reference value is changed when said fuel supply to said engine is interrupted.

5. A misfire-detecting system according to claim 4, wherein said second-mentioned predetermined reference value is changed to a smaller value when said fuel supply to said engine is interrupted.

6. A misfire-detecting system according to claim 2, wherein said degree to which the detected value of said sparking voltage exceeds said predetermined reference value is an amount by which the detected value of said sparking voltage exceeds said first-mentioned predetermined reference value.

7. A misfire-detecting system according to any of claims 1 to 3, wherein determination of abnormality of said engine is inhibited for a predetermined time period after said interruption of fuel supply is started, irrespective of whether said misfire-determining means determines that a misfire has occurred.

8. A misfire-detecting system according to claim 4, wherein determination of abnormality of said engine is inhibited for a predetermined time period after said interruption of fuel supply is started, irrespective of whether said misfire-determining means determines that a misfire has occurred.

9. A misfire-detecting system according to claim 5, wherein determination of abnormality of said engine is inhibited for a predetermined time period after said interruption of fuel supply is started, irrespective of whether said misfire-determining means determines that a misfire has occurred.

10. A misfire-detecting system according to claim 6, wherein determination of abnormality of said engine is inhibited for a predetermined time period after said interruption of fuel supply is started, irrespective of whether said misfire-determining means determines that a misfire has occurred.

11. A misfire-detecting system according to claim 7, wherein said at least one cylinder comprises a plurality of cylinders, said abnormality determining means comprising first determining means for determining whether or not said system is abnormal, by monitoring all of said cylinders as a whole, and second determining means for determining whether or not said system is abnormal, by monitoring said cylinders individually.

12. A misfire-detecting system according to claim 8, wherein said at least one cylinder comprises a plurality of cylinders, said abnormality determining means comprising first determining means for determining whether or not said system is abnormal, by monitoring all of said cylinders as a whole, and second determining means for determining whether or not said system is abnormal, by monitoring said cylinders individually.

13. A misfire-detecting system according to claim 9, wherein said at least one cylinder comprises a plurality of cylinders, said abnormality determining means comprising first determining means for determining whether or not said system is abnormal, by monitoring all of said cylinders as a whole, and second determining means for determining whether or not said system is abnormal, by monitoring said cylinders individually.

14. A misfire-detecting system according to claim 10, wherein said at least one cylinder comprises a plurality of cylinders, said abnormality determining means comprising first determining means for determining whether or not said system is abnormal, by monitoring all of said cylinders as a whole, and second determining means for determining whether or not said system is abnormal, by monitoring said cylinders individually.

* * * * *